US005138288A

United States Patent [19]

Blackburn

[11] Patent Number: 5,138,288

[45] Date of Patent: Aug. 11, 1992

[54] MICRO STRIP FILTER HAVING A VARACTOR COUPLED BETWEEN TWO MICROSTRIP LINE RESONATORS

[75] Inventor: Dane E. Blackburn, Sunrise, Fla.

[73] Assignee: Motorola, Inc., Schaumburg, Ill.

[21] Appl. No.: 676,023

[22] Filed: Mar. 27, 1991

[51] Int. Cl.[5] ..... H01P 1/203

[52] U.S. Cl. ..... 333/202; 333/205; 333/235; 333/134

[58] Field of Search ..... 333/202, 205, 219, 235, 333/246, 134, 206, 207

[56] References Cited

U.S. PATENT DOCUMENTS

| | | | |
|---|---|---|---|
| 3,534,301 | 10/1970 | Golembeski | 333/204 |
| 3,798,578 | 3/1974 | Konishi et al. | 333/234 X |
| 4,121,182 | 10/1978 | Makimoto et al. | 333/205 |
| 4,157,517 | 6/1979 | Kneisel et la. | 333/205 |
| 4,418,324 | 11/1983 | Higgins | 333/205 X |
| 4,609,892 | 9/1986 | Higgins, Jr. | 333/204 |
| 4,661,790 | 4/1987 | Gannon et al. | 333/234 |
| 4,731,596 | 3/1988 | Cruchon et al. | 333/205 X |
| 4,785,271 | 11/1988 | Higgins, Jr. | 333/202 |
| 4,799,034 | 1/1989 | Silverman et al. | 333/205 X |
| 4,940,955 | 7/1990 | Higgins, Jr. | 333/204 |
| 5,021,757 | 6/1991 | Kobayashi et al. | 333/204 X |

*Primary Examiner*—Eugene R. LaRoche
*Assistant Examiner*—Seung Ham
*Attorney, Agent, or Firm*—Robert S. Babayi

[57] ABSTRACT

A transmission line filter is provided which includes a first resonator having open ends being coupled to a second resonator disposed on a substrate. A transmission zero frequency is tuned by means of a varactor which is coupled between the first and the second resonator. The first resonator includes a terminal for applying a control voltage to the varactor for varying its capacitance.

9 Claims, 2 Drawing Sheets

MICRO STRIP FILTER HAVING A VARACTOR COUPLED BETWEEN TWO MICROSTRIP LINE RESONATORS

TECHNICAL FIELD

This invention relates generally to the field of filters in particular to transmission line filters having tunable zero.

BACKGROUND

Filters are extensively used in communication devices particularly in radio receivers to provide selectivity for the received signals. A number of factors including the type and number of resonators in the filter topology determine the selectivity of a filter. Depending on the application, the filter topology may include any number of quarter-wave resonators, half-wave resonators or a combination of them.

In order to form a particular filter topology, transmission line filters provide an attractive alternative to filters which utilize discrete components. For example, conventional stripline or microstrip resonators typically utilize a substrate which can be made of ceramic or another dielectric material. For microstrip construction, a conductive runner is formed on one side of the substrate with a ground plane on the other side. The stripline configuration utilizes two such structures with ground planes on the outside and the conductive runners therebetween. The resonant frequency of the resonators is determined by such factors as dielectric constant of the substrate, the thickness of the substrate, and the length and the width of the conductive runner. An inverse relationship exists between the size of the transmission line structure and the resonant frequency of the resonator. That is, for lower resonant frequencies, a substantially longer transmission line structure is needed and vice versa.

A quarter-wave resonator may be produced by providing a ground path at one end of the conductive runner. A half wave (or a full wave) resonator may be produced by either grounding both ends of the conductive runner or by providing opens at both ends. The transmission line filter is produced by forming a particular resonator configuration, including different types of resonators, on the dielectric substrate to create the desired filter topology.

Generally, transmission line filters utilize a number of interdigitated quarter-wave length resonators to provide the desired passband for a specified selectivity. However, the specified selectivity may also be achieved by tuning a transmission zero produced by capacitive coupling of the quarter-wave resonators which are formed in a combined arrangement on the filter substrate. Conventionally, the transmission zero frequency is tuned by controlling the capacitive coupling between the resonators by means of varactors which have one terminal coupled to the open ends of each of the quarter-wave resonators and voltage at their other terminals which are coupled to each other. In this arrangement, the DC ground path for the varactors are provided through the grounded end of the quarter-wave resonators. This arrangement, however, requires many varactors and a larger transmission line structure specially when lower frequency pass band filters in UHF and VHF bands are needed. Therefore, it is desired to provide a simple, highly-selective, passband filter.

SUMMARY OF THE INVENTION

Briefly, according to the invention, a transmission line filter is provided which includes a first resonator having open ends and a second resonator being coupled thereto. The first resonator includes a terminal for receiving a control voltage. A varactor is coupled between the first resonator and the second resonator such that the control voltage sets the voltage potential across the varactor.

DETAILED DESCRIPTION OF THE PREFERRED EMBODIMENT

Figure 1:
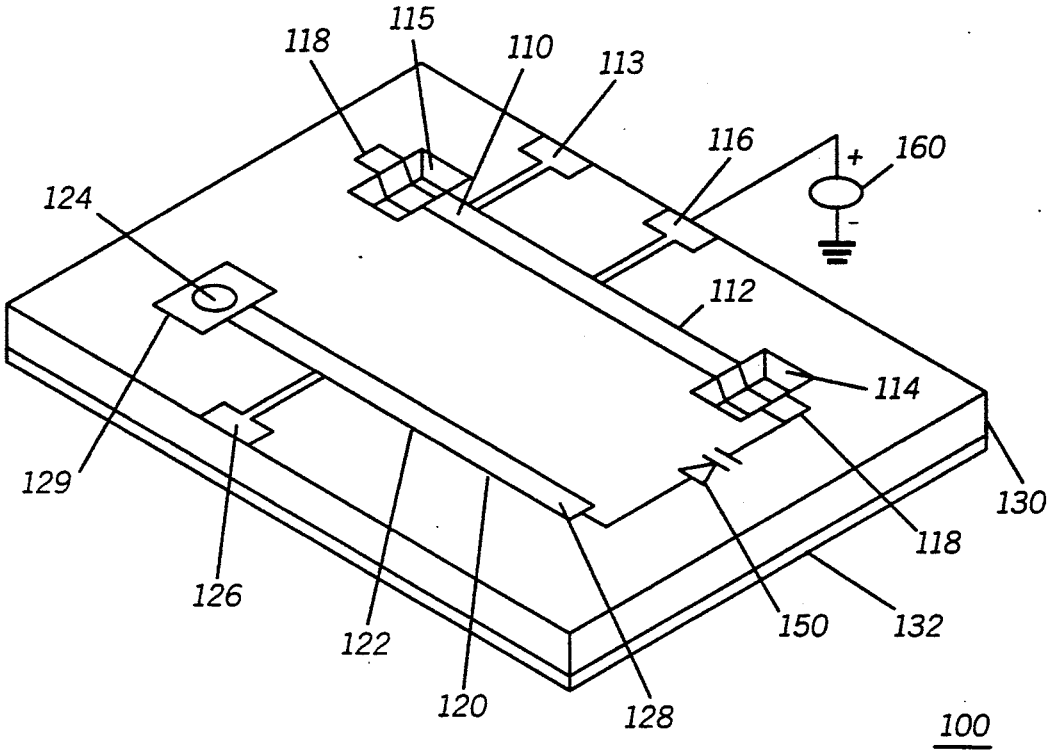
FIG. 1, is an isometric view of one embodiment of the transmission line filter of the present invention.

Referring to FIG. 1, a transmission line structure, comprising a microstrip filter 100, includes a substrate 130 made of a suitable dielectric material. The substrate 130 has a conductive ground plane 132 disposed on a major bottom surface and a first resonator 110 and a second resonator 120 disposed on a major top surface. In this embodiment, the first resonator 110 comprises a conductive runner 112 having open ends 118; wherein the ground plane 132 provides the opposing conductive surface. The first resonator 110 is sized to behave as a half-wave resonator at a resonant frequency in which the two ends comprise the peak desired radio frequency (RF) voltage points. It is well known that at the center of an open end half wave resonator, such as the first resonator 110, exist an RF node at which zero potential exists at the resonant frequency. Preferably, the substrate 130 includes two areas of reduced thickness forming pockets 114 and 115, with the conductive runner 112 extending at least into these areas. At the pockets 114 and 115, the conductive runner 112 is more closely spaced to the ground plane 132; thereby providing increased capacitance and decreased inductance per unit length. The pockets 114 and 115, therefore, making the first resonator 110 capable of operating at low frequencies without the size requirement of conventional resonator designs. A first RF tap 113 is positioned along the length of the conductive conductive runner 112 where a proper impedance is presented by the first resonator 110 to external circuitry. As is well known, depending upon application, the first RF tap 113 may be used as an input or an output RF terminal.

The second resonator 120 includes a conductive runner 122 which is shorted to the ground plane 132 at a grounded end 129 via a ground-hole 124 and includes an opposing open end 128. The resonator 120, therefore, comprises a quarter-wave resonator. A second RF tap 126 is positioned along the length of the conductive runner 122 where the second resonator 120 may present a proper impedance to external circuitry.

Accordingly, the transmission line filter 100 is formed by the first resonator 110 having open ends 118 and the second resonator which in this embodiment of the invention comprises a quarter wave resonator having the grounded end 129. The position of the first resonator 110 and the second resonator 120 on the substrate 130 produces a coupling therebetween which is both capacitive and inductive. The coupling of the first resonator 110 and the second resonator 120 creates a transmission zero frequency for the filter 100. The transmission zero frequency is a frequency at which RF energy reaches its minimum; i.e. zero. By tuning the transmission zero frequency, a specified selectivity for the filter 100 may be achieved.

According to the invention, the transmission zero frequency is tuned by varying capacitive coupling between the first resonator 110 and the second resonator 120 by means of a varactor 150. The varactor 150 is coupled between the first resonator open end 118 and the open end 128 of the second resonator 120. A DC voltage source 160 provides a control voltage for setting the potential across the varactor 150 to vary its capacitance. The voltage source 160 is coupled to a control voltage terminal 116 along the length of the conductive runner 112. The control voltage terminal 116 is positioned at the RF node or the center of the first resonator 110 where a zero RF potential exist at the resonant frequency. In this way, the impedance of the control voltage source 160 does not affect the resonator frequency signal propagating through the resonator. Accordingly, the voltage potential across the varactor 150 is set by the control voltage applied to the open-ended first resonator 110. It should be noted that as arranged, the ground potential for the varactor 150 is provided by the grounded end 129 of the second resonator 120.

The first resonator 110 being a half wave resonator has only one RF node, however, more than one RF node may exist along the length of a resonator. For example, a full-wave resonator has two RF nodes.

The control voltage signal comprises a DC signal the variations of which varies the capacitance of the varactor 150. The transmission zero frequency is partly controlled by the capacitive coupling between the open end of 118 of the first resonator 110 and the open end 128 of the second resonator 120. Therefore, changing the capacitance by varying control voltage potential across the varactor 150 provides an active tuning mechanism for the transmission zero frequency.

Figure 2:
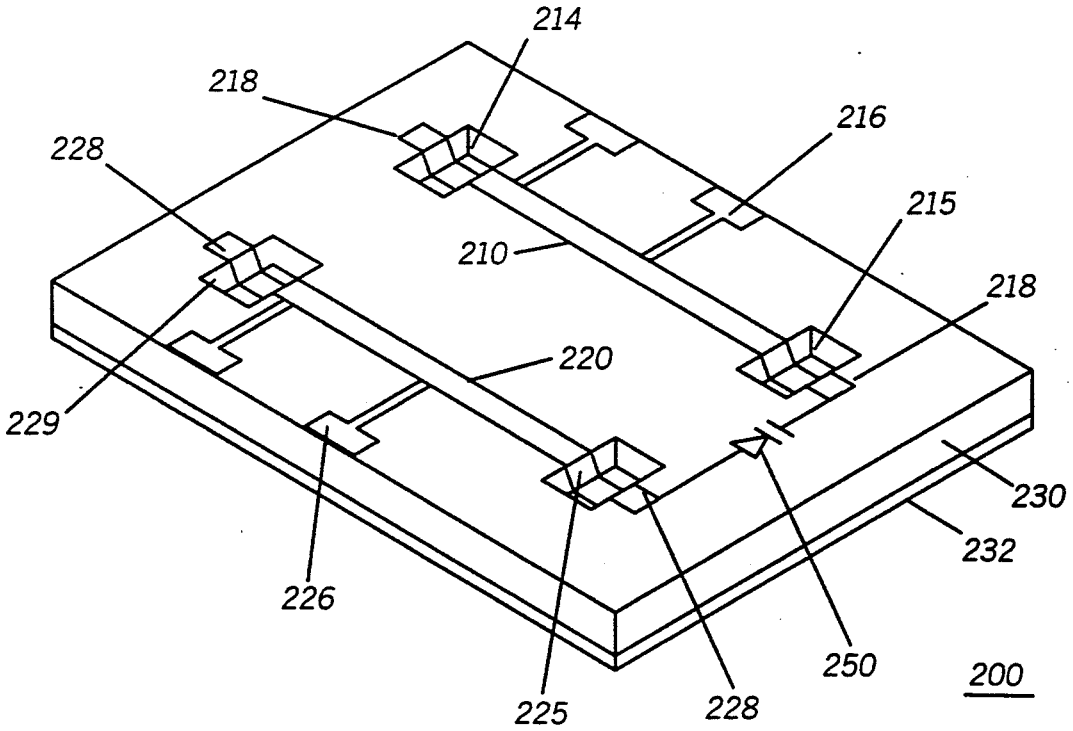
FIG. 2, is an isometric view of another embodiment of the transmission line filter of the present invention.

Referring to FIG. 2, another embodiment of the transmission line filter of the present invention comprises a filter 200 which has similar transmission line structure to the filter 100 of FIG. 1. The filter 200 has a first resonator 210 and a second resonator 220 disposed on top surface of a substrate 230 which has a ground plane 232 on its bottom surface. The first resonator 210 includes open ends 218, pockets 214 and 215 and a first control voltage terminal 216 for receiving a first control voltage. In this embodiment, the second resonator 220 also comprises a half-wave resonator having open ends 218 and pockets 224 and 225 similar to the first resonator 210. The second resonator 220 includes a second control voltage terminal 226 for receiving a second control voltage. Therefore, the difference between the first control voltage and the second control voltage sets the voltage potential across a varactor 250. The transmission zero may be tuned by varying either of the first or second control voltages or both of them simultaneously.

Figure 3:
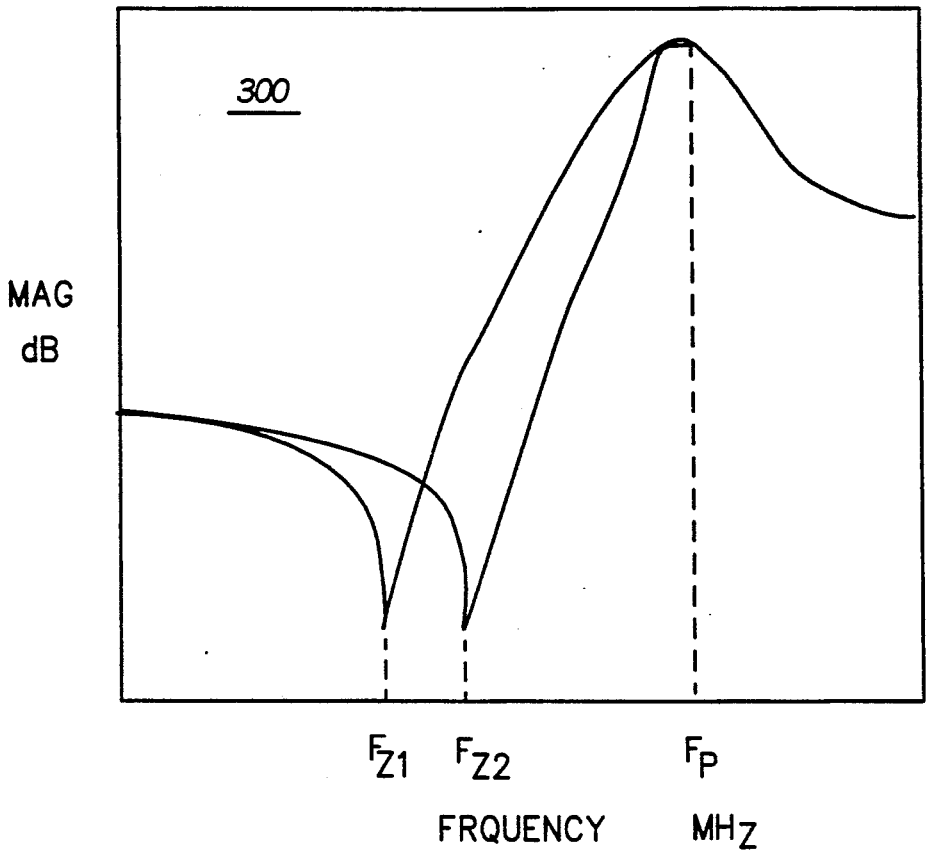
FIG. 3 is a graph of frequency response of the transmission line filter of FIG. 1.

Referring to FIG. 3, the frequency response of the transmission line filter 100 is depicted by a graph 300. The X-axis of the graph 200 represents the frequency in Mhz and the Y-axis represents transmission magnitude in dB. Tuning of the transmission zero for increasing the selectivity of the filter provides the advantage that during tuning process, peak frequency $F_p$ is substantially unaffected. As shown, the frequency response of the filter 100 comprises a passband response wherein a transmission zero frequency at $F_{z1}$ is created for a particular varactor capacitance setting. As the varactor capacitance is varied the transmission zero frequency moves to $F_{z2}$. Accordingly, the selectivity of the filter 100 is increased without substantially affecting the peak frequency $F_p$.

Figure 4:
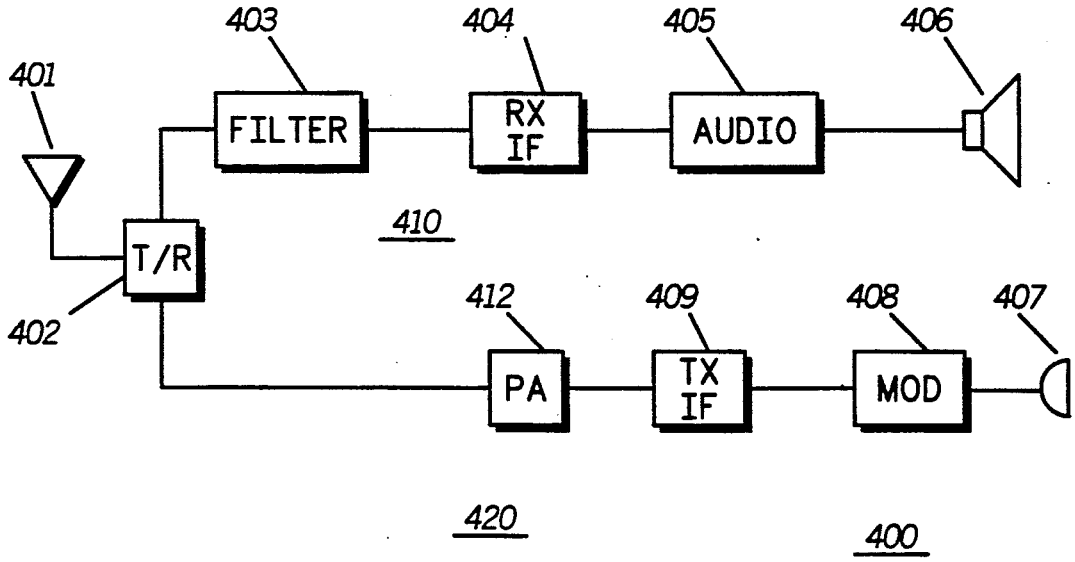
FIG. 4 is a block diagram of a radio transceiver which utilizes the transmission line filter of FIG. 1.

Referring to FIG. 4, the transmission line filter of the present invention is utilized in a radio 400 comprising any well known radio, such as a Saber portable two-way radio manufactured by Motorola Inc, which may operate in receive or transmit modes. The radio 400 includes a receiver section 410 and a transmitter section 420 which comprise means for communicating, i.e. transmitting or receiving, communication signals for the radio.

In the receive mode, the portable radio 400 receives a communication signal via an antenna 401. A transmit/-receive (T/R) switch 402 couples the received communication signal to a filter 403 which comprises the transmission line filter of the present invention and provides the desired selectivity for the received communication signal. The output of the filter 403 is applied to a well known receiver IF section 404 which recovers the base band signal. The output of the receiver IF section is applied to a well known audio section 405 which among other things amplifies audio messages and presents them to a speaker 406. It may be appreciated by one of ordinary skill in the art that the control voltage for tuning the transmission zero frequency of the filters 403 may be provided by any suitable means including a controller means (not shown) which controls the entire operation of the radio 400.

In the transmit mode, audio messages are inputted via a microphone 407, the output of which is applied to a well known modulator 408 to provide a modulating signal for a transmitter IF section 409. A transmitter power amplifier 412 amplifies the output of the transmitter IF section 409 and applies it to a the antenna 401 through the T/R switch 402 for transmission of the communication signal. It may be appreciated that, a transmission line filter according to the principals of the present invention may also be utilized in a suitable section of the transmitter section 420. Accordingly, the filters 403 and ands any filter which may be used in the transmitter section 420 comprise transmission line filters for filtering signals within the communication means, i.e. the receiver section 410 and the transmitter section 420.

As described above, the transmission line filter constructed according to the principals of the present invention provides a simple and small size filter which may be utilized in a variety of communication devices. It may be appreciated that the principals of the present invention are equally applicable to stripline or any other suitable transmission line structures.

What is claimed is:

1. A transmission line filter comprising:

a first resonator having open ends including a terminal for receiving a control voltage;

a second resonator being coupled to said first resonator; and a varactor being coupled between said first resonator and said second resonator such that said control voltage sets the voltage potential across said varactor, wherein said second resonator has at least one grounded end.

2. A transmission line filter comprising:

a first resonator having open ends including a terminal for receiving a control voltage;

a second resonator being coupled to said first resonator; and a varactor being coupled between said first resonator and said second resonator such that said control voltage sets the voltage potential across said varactor, wherein said second resonator has open ends including a second terminal for receiving a second control voltage.

3. The transmission line filter of claim 1, wherein said first resonator includes pockets at at least one open end for substantially increasing capacitive loading.

4. A radio transceiver comprising:

communication means for communicating communication signals;

a transmission line filter for filtering signals within said communication means comprising:

a first resonator having open ends including a terminal for receiving a control voltage;

a second resonator being coupled to said first resonator, wherein said second resonator has at least one grounded end; and a varactor being coupled between said first resonator and said second resonator such that said control voltage sets a voltage potential across said varactor.

5. A radio transceiver comprising:

communication means for communicating communication signals;

a transmission line filter for filtering signals within said communication means comprising:

a first resonator having open ends including a terminal for receiving a control voltage;

a second resonator being coupled to said first resonator, and a varactor being coupled between said first resonator and said second resonator such that said control voltage sets a voltage potential across said varactor, wherein said second resonator has open ends including a second terminal for receiving a second control voltage.

6. The radio of claim 4, wherein said first resonator includes pockets at at least one open end for substantially increasing capacitive loading.

7. A transmission line structure comprising:

a substrate having a ground plane disposed on a major bottom surface;

a first conductive runner disposed on top surface of said substrate having open ends including a terminal for receiving a control voltage;

a second conductive runner disposed on top surface of said substrate having a grounded end and an open end; and a varactor being coupled between one open end of said first conductive runner and the open end of said second conductive runner such that said control voltage sets the voltage potential across said varactor.

8. A transmission line structure comprising:

a substrate having a ground plane disposed on a major bottom surface;

a first conductive runner disposed on top surface of said substrate having open ends including a terminal for receiving a control voltage;

a second conductive runner disposed on top surface of said substrate having a grounded end and an open end; and a varactor being coupled between one open end of said first conductive runner and the open end of said second conductive runner such that said control voltage sets the voltage potential across said varactor, wherein said second conductive runner has open ends including a second terminal for receiving a second control voltage.

9. The transmission line structure of claim 7, wherein said substrate includes at least one pocket through which at least one of the first conductor or second conductor extends.

* * * * *